United States Patent [19]

Shimizu et al.

[11] Patent Number: 4,994,708

[45] Date of Patent: Feb. 19, 1991

[54] COLD CATHODE DEVICE

[75] Inventors: Akira Shimizu, Sagamihara; Takeo Tsukamoto, Atsugi; Akira Suzuki; Masao Sugata, both of Yokohama; Isamu Shimoda, Zama; Masahiko Okunuki, Tokyo, all of Japan

[73] Assignee: Canon Kabushiki Kaisha, Tokyo, Japan

[21] Appl. No.: 515,352

[22] Filed: Apr. 30, 1990

Related U.S. Application Data

[63] Continuation of Ser. No. 341,298, Apr. 21, 1989, abandoned, which is a continuation of Ser. No. 185,302, Apr. 19, 1988, abandoned, which is a continuation of Ser. No. 65,403, Jun. 23, 1987, abandoned.

[30] Foreign Application Priority Data

Jul. 1, 1986 [JP] Japan ..... 61-152700
Jan. 28, 1987 [JP] Japan ..... 62-16147

[51] Int. Cl.[5] ..... H01J 1/46
[52] U.S. Cl. ..... 313/306; 313/302; 313/303; 313/305
[58] Field of Search ..... 313/302, 303, 304, 305, 313/309, 306, 366

[56] References Cited

U.S. PATENT DOCUMENTS

| | | | |
|---|---|---|---|
| 3,755,704 | 8/1973 | Spindt et al. | 313/309 |
| 3,872,352 | 3/1975 | Sasaki et al. | 313/302 |
| 3,921,022 | 11/1975 | Levine | 313/309 |
| 3,970,887 | 7/1976 | Smith et al. | 313/309 |
| 4,008,412 | 2/1977 | Yuito et al. | 313/309 |
| 4,370,797 | 2/1983 | Van Gorkom et al. | 313/303 |

FOREIGN PATENT DOCUMENTS

| | | | |
|---|---|---|---|
| 2109156 | 5/1983 | Netherlands | 313/309 |

*Primary Examiner*—Leo H. Boudreau
*Assistant Examiner*—Michael Razavi
*Attorney, Agent, or Firm*—Fitzpatrick, Cella, Harper & Scinto

[57] ABSTRACT

A cold cathode device wherein a cold cathode and an anode face each other with an electron transit path intermediated therebetween, and one or more control electrodes structurally insulated from the said cathode and the anode, are provided exposing to the electron transit path. A cold cathode vacuum tube has an electron emission element having a p-type semiconductor region on an electron emission side and a work function lowering region with junctional relation to the p-type semiconductor region; and a plate electrode structurally insulated from the electron emission element by using an insulation layer which is formed with an electron transmit path corresponding in position to an electron emission area of the electron emission element.

10 Claims, 3 Drawing Sheets

COLD CATHODE DEVICE

This application is a continuation of application Ser. No. 07/341,298 filed Apr. 21, 1989 now abandoned, which is a continuation of application Ser. No. 07/185,302, filed Apr. 19, 1988 now abandoned, which is a continuation of application Ser. No. 07/065,403 filed on June 23, 1987 now abandoned.

BACKGROUND OF THE INVENTION

1. Field of the Invention

The present invention relates to a cold cathode device which can perform various functions such as amplification by controlling the flow of electrons emitted from a cold cathode.

2. Related Background Art

Semiconductor devices such as diodes and transistors constructed of p-type and n-type semiconductor regions are widely used as circuit elements performing rectification or amplification.

Semiconductor devices have many advantages: small size, light weight, feasibility of integration, large cost reduction, long life, high reliability and so on. Semiconductor devices are used accordingly in various applications such as information machines including computers, electronic household appliances including television, radio and the like.

Semiconductor devices such as diodes and transistors have some problems, including that malfunctioning may occur due to radiation of alpha-rays or the like. Semiconductor devices cannot be used in the range of GHz due to a limit of response speed which is in the order of up to 100 MHz in case of Si transistors.

A vacuum tube may be used to realize a high speed response. However, a hot cathode is generally used in a tube to emit electrons from the surface of a metal by heating it to high temperature in vacuum. One of the disadvantages of tubes is therefore a warm-up time required for such heating. Further, A tube of this kind includes therein a cathode, grid, plate and other electrodes so that it is difficult to make it compact. Because of heat radiation, a tube cannot be integrated with semiconductor devices.

SUMMARY OF THE INVENTION

It is an object of the present invention to solve the above-mentioned problems and provide a cold cathode device which can be down-sized and integrated, can be operated at high speed, and can have a high input impedance.

According to an embodiment of this invention, a cold cathode device is provided wherein a cold cathode and an anode face each other with an electron transit path intermediated therebetween, and one or more control electrodes structurally insulated from the cathode and anode are provided exposing to the electron transit path.

A cold cathode device constructed as above can be integrated with semiconductor devices. A warm-up time is not needed. Further, a high speed operation and a high input impedance as of a tube can be attained by controlling the flow of electrons with control electrodes.

According to another embodiment of this invention, a cold cathode vacuum tube is provided which comprises an electron emission element having a p-type semiconductor region on an electron emission side and a work function lowering region with junctional relation to the p-type semiconductor region, and a plate electrode structurally insulated from the electron emission element by using an insulation layer which is formed with an electron transit path corresponding in position to an electron emission area of the electron emission element.

The cold cathode tube of this embodiment is fabricated on a semiconductor substrate, wherein a junction-type electron emission area formed on the semiconductor substrate is used in place of a hot cathode, and at least a plate electrode is provided which is structurally insulated from the electron emission area by using an insulation layer.

A diode is made if a grid electrode is not provided between the cold cathode and the plate electrode, a triode, tetrode and the like are made with one, two and more grid electrodes, respectively.

Further, the cold cathode tube can operate without vacuum if a distance between the electron emission element and the grid electrode or the plate electrode is made shorter than a mean free path of electrons under atmospheric pressure, i.e., if the distance is set at about 1 micron.

DETAILED DESCRIPTION OF THE PREFERRED EMBODIMENTS

The embodiments of the present invention will be described in detail with reference to the accompanying drawings.

Figure 1:
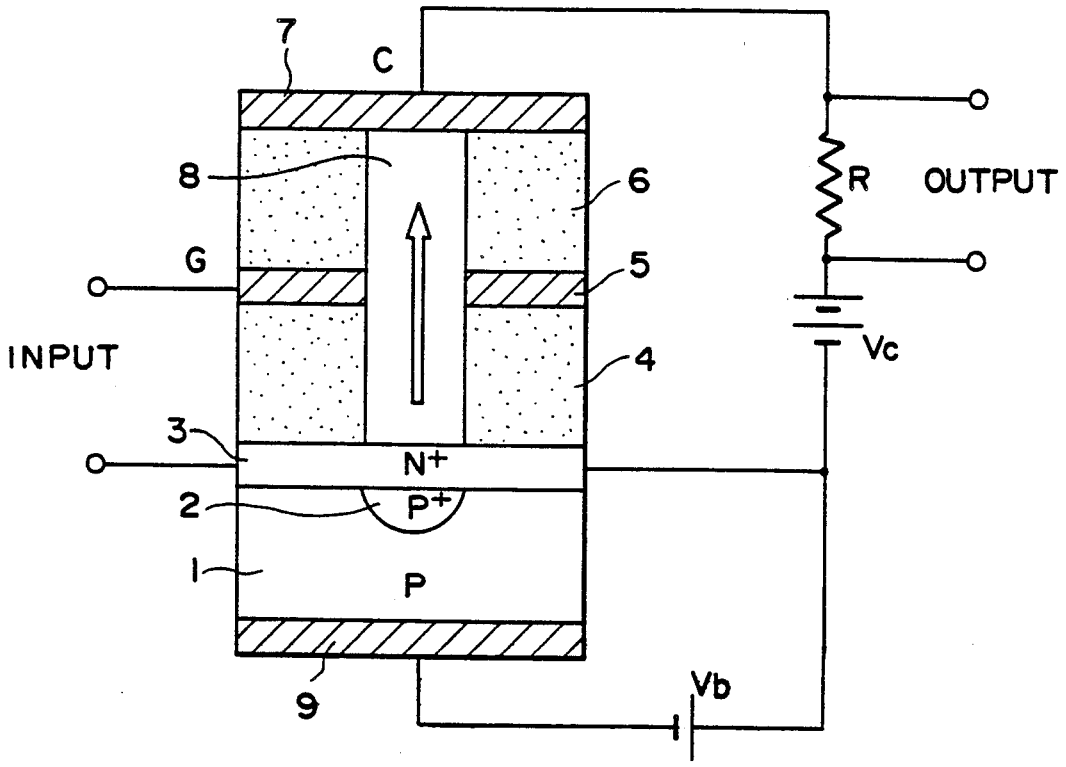
FIG. 1 is a schematic diagram partially in section showing an embodiment of the cold cathode device according to the present invention.

FIG. 1 is a schematic diagram partially in section showing an embodiment of the cold cathode device according to the present invention.

In the Figure, a pn-type cold cathode is made such that a $P^+$ region 2 is formed in a p-type semiconductor substrate 1, on the opposite surface of which an electrode 9 is formed and on which a thin $N^+$ layer 3 is formed. A reverse bias voltage Vb is applied to generate avalanche breakdown at a depletion layer between the highly doped $P^+$ region 2 and $N^+$ layer 3 of the cold cathode to thereby emit accelerated electrons from the surface of the $N^+$ layer 3. Since electrons are accelerated in the depletion layer from the $P^+$ region to the $N^+$ layer 3, the energy distribution of emitted electrons is sharp and a high emission efficiency is obtained.

A grid electrode 5 is provided above the $N^+$ layer 3 with an insulation layer 4 therebetween, and a collector electrode 7 is provided above the grid electrode 5 with an insulation layer 6 therebetween. The collector electrode 7 faces the electron emission surface of the cold cathode at an electron transit path 8. Since the grid electrode 5 and the insulation layers 4 and 6 are formed one upon another, the cold cathode device can readily be fabricated using a conventional semiconductor manufacturing processes, and integrated with other semiconductor devices.

In the cold cathode device constructed as above, if a voltage Vc is applied between the N+ layer 3 and the collector electrode 7, electrons emitted from the cold cathode will be accelerated in the direction of an arrow within the electron transit path 8 and collected by the collector electrode 7. The flow of electrons is influenced to a large degree by a potential of the grid electrode 5, to accordingly perform a similar function to that of a hot cathode tube.

Particularly, as shown in FIG. 1, when a voltage Vc is applied via a load resistor R between the N+ layer 3 and the collector electrode 7 and a small signal is applied to the grid electrode 5, the flow of electrons within the electron transit path 8 varies to a large extent in accordance with a potential change at the grid electrode 5 and hence the collector current varies. Thus, an amplified input signal is obtained at a terminal across the load resistor R.

In the above embodiment, only one layer of grid electrode 5 is used to embody a triode. The invention is not limited thereto, but two or more grid electrodes may be laid to embody a triode and tetrode, respectively.

Further, in the above embodiment, an electron emission element of pn junction avalanche breakdown type is used as the cold cathode. Obviously, the type of an electron emission element may include a forward bias pn junction type wherein electrons are injected into the p layer, an MIM type wherein an insulator layer is sandwiched between metal layers, an electric field emission type, a surface conduction type, and other types.

Furthermore, low noise and long life of the cold cathode device are ensured if the electron transit path 8 is maintained vacuum or filled with gas.

As seen from the detailed description of the cold cathode device of this embodiment, heating and hence a warm-up time are not necessary. The control electrodes are laid between insulation layers so that the cold cathode device can be integrated with other semiconductor devices. Further, high speed operation and a high input impedence similar to a vacuum tube, can be attained by controlling the flow of electrons with the control electrodes.

Figure 2:
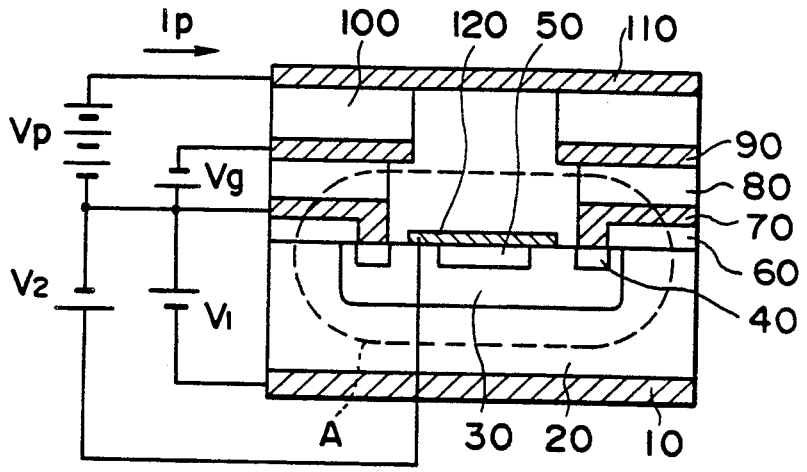
FIG. 2 is a schematic diagram partially in section showing, an embodiment of the cold cathode tube according to the present invention.

FIG. 2 is a schematic diagram partially in section showing an embodiment of the cold cathode tube according to the present invention.

Referring to the FIG., an insulation layer is formed on one surface of an n-type Si (100) substrate 20. An opening is formed in the insulation layer by means of the photolithography or the like to form a p-type semiconductor region 30 by means of the impurity diffusion method or the like. A P+ region 40 and a P+ region 50 for ohmic contact are formed in the p-type region 30 by means of the ion implantation or the like. On the surface of the p-type region 30 there is formed a low work function film 120 to be described later which constitutes an electron emission area. An electrode 70 such as aluminum is formed on an insulation layer 60. A grid electrode 90 such as aluminum, polysilicon or the like is formed on an insulation layer 80 such as $SiO_2$. A plate electrode 110 such as aluminum is formed on an insulation layer 100 under which the grid electrode 90 has been formed. An electrode 10 is formed on the bottom surface of the n-type Si substrate 20 with an ohmic contact layer interposed therebetween.

The low work function film 120 used in this embodiment is preferably a metal having a work function lower than about 2.5 eV. For example, Li, Na, K, Rb, Sr, Cs, Ba, Eu, Yb, Fr or the like may be used. Alkali metal silicide such as CsSi and RbSi, metal carbide, boron or the like may be used to stabilize the low work function film 120.

Since electron affinity of silicon is small at the plane (100), the above embodiment uses this plane to make it easy to emit electrons.

Figure 3:
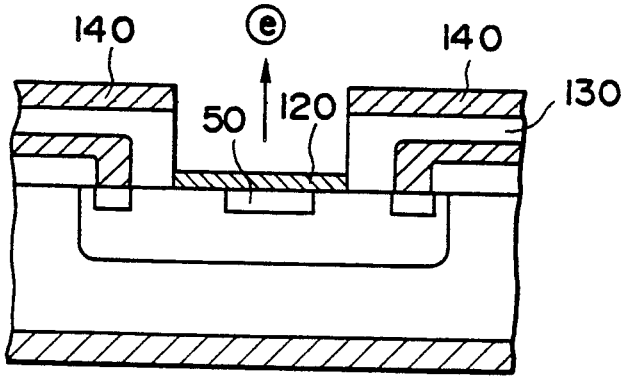
FIG. 3 is a schematic, sectional view showing a forward-biased pn junction type electron emission device with lead electrodes.

Although the electron emission element having the p-type region on the electron emission side and a low work function film in junctional relation to the p-type region is used to emit electrons with high efficiency by reverse-biasing it, another arrangement shown in FIG. 3 may be employed. In this arrangement, a lead electrode 140 is provided on an insulation layer 130 and a positive voltage is applied thereto to lower the work junction with the help of the Shottky effect and to further enhance electron emission.

With the cold cathode tube constructed as above, a voltage $V_1$ is applied between the electrodes 10 and 70 to forward-bias the pn junction, and a reverse bias voltage $V_2$ is applied between the electorde 70 and the low work junction film 120. Then, electrons are injected from the n-type Si substrate 20 to the p-type region 30, and travel through the extremely thin p-type region without being scattered by lattices so that the electrons become hot electrons at the interface between the low work function film and the p-type region 30 and thereafter, they are emitted from the surface of the low work function film 120. The emitted electrons are controlled by a bias voltage Vg applied between the electrodes 70 and 90. As the negative bias voltage Vg becomes smaller, i.e., as the absolute value of Vg becomes larger, the number of electrons reaching the plate electrode decreases because of repulsion of the bias voltage. Conversely, as the voltage Vg becomes larger, i.e., as the absolute value of Vg becomes smaller, the electrons pass through the grid electrode 90 and reach the plate electrode, thus increasing the plate current $I_p$.

Figure 4:
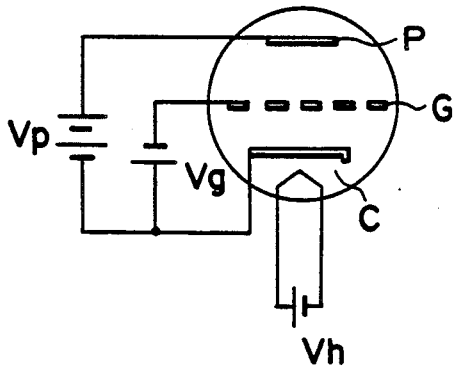
FIG. 4 shows a triode equivalent to the cold cathode tube of the embodiment.

The cold cathode tube of this embodiment described above is a triode having one grid electrode, and is represented by the equivalent circuit shown in FIG. 4.

Particularly, the plate P, grid G and cathode C shown in FIG. 4 correspond to the plate electrode 110, grid electrode 90 and electron emission element A shown in FIG. 2, respectively.

The electron emission element having the electron emission area is not limited to a forward-biased pn junction type, but any other type may be used so long as it can be fabricated on a semiconductor substrate.

Figure 5:
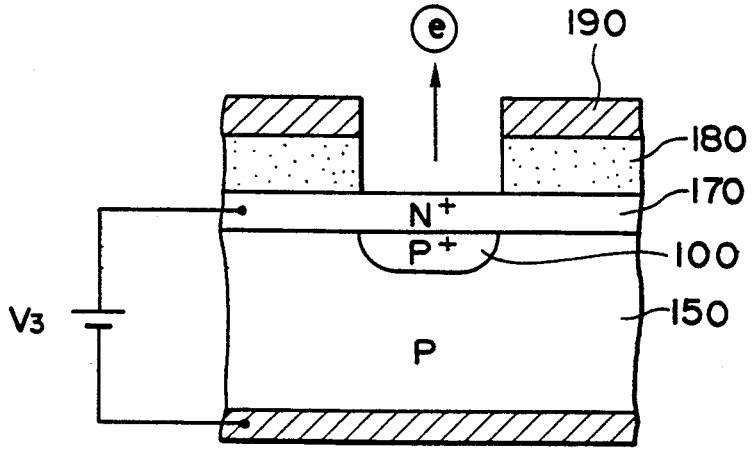
FIG. 5 is a schematic, sectional view showing another embodiment of the electron emission element used in the cold cathode tube according to the present invention.

FIG. 5 is a schematic, cross sectional view showing another embodiment of the electron emission element used in the cold cathode tube according to this invention. The electron emission element of this embodiment is of a pn junction avalanche breakdown type.

Referring to FIG. 5, a reverse bias voltage $V_3$ is applied between a P+ layer 160 and an N+ layer 170 respectively formed in an on a p-type semiconductor substrate 150. Application of the reverse voltage $V_3$ causes avalanche breakdown at the depletion region between the highly doped P+ layer 160 and N+ layer 170 so that accelerated electrons are emitted from the surface of the N+ layer 170. Since electrons are accelerated from the P+ layer 160 to the N+ layer 170, the energy distribution of emitted electrons is sharp and a high emission efficiency is obtained.

By applying a voltage to an acceleration electrode 190, the emitted electrons are accelerated and the work function is lowered with the help of the Shottky effect, thus enabling to improve the electron emission efficiency.

In the above embodiment, only one grid electrode is used to embody a triode. A diode may be embodied without a grid electrode, and also a tetrode and pentode may be embodied with two and three grid electrodes, respectively.

As seen from the foregoing detailed description of the embodiment, the cold cathode tube can be fabricated on a semiconductor substrate, wherein the electron emission element having the p-type region on the electron emission side and a low work function film in junctional relation to the p-type region is used in place of a hot cathode, and a plate electrode is provided which is structurally insulated from the electron emission area by using an insulation layer. As a result, the cold cathode tube of this embodiment can operate at high speed since electrons moving in a solid body as in the case of a semiconductor device are not used. In addition, it has a high input impedance and is not influenced by radiation of a alpharays or the like. Further, since a hot cathode as of a conventional tube is not used, it has a long life and a good stability. Furthermore, a cold cathode tube small in size and light in weight can be fabricated easily by using conventional semiconductor fine work processing.

Still further, since the cold cathode tube is fabricated on a semiconductor substrate, it can be integrated with other semiconductor devices.

A diode is made if a grid electrode is not provided, and a triode, tetrode and the like are made with one, two and more grid electrodes, respectively.

We claim:

1. A cold cathode electronic tube for processing a signal comprising:

a cold cathode;

an anode opposed to said cathode;

an electron transit path disposed between said anode and said cathode;

a control electrode for inputting the signal to be processed, wherein said control electrode is electrically insulated, structurally, from said cathode and said anode and is exposed to said electron transit path; and an output terminal connected between said anode and said cathode, wherein an electron stream is provided along said electron transit path, and wherein the electron stream is modulated in accordance with the signal, to produce an output signal at said output terminal.

2. A cold cathode electronic tube according to claim 1, wherein said cold cathode comprises a solid electron emission element.

3. A cold cathode electronic tube according to claim 2, wherein said solid electron emission element comprises a pn junction avalanche breakdown type electron emission device.

4. A cold cathode vacuum tube diode for processing a signal comprising:

an electron emission element cathode comprising an electron emission side having a p-type semiconductor region and a work function lowering region having a junction with said p-type semiconductor region;

and insulation layer;

a plate electrode electrically insulated, structurally, from said electron emission element by means of said insulation layer, said insulation layer having an electron transit path corresponding in position to an electron emission area of said electron emission element; and an output terminal connected between said electron emission element cathode and said plate electrode, wherein an electron stream is provided along said electron transit path, and wherein the electron stream is modulated in accordance with the signal to produce an output signal.

5. A cold cathode vacuum tube diode according to claim 4, wherein a control electrode is formed between said electron emission area of said electron emission element and said plate electrode, and wherein said control electrode is electrically insulated, structurally, from said electron emission element and from said plate electrode.

6. A cold cathode electronic tube according to claim 1, wherein the processing comprises amplification.

7. A cold cathode electronic tube according to claim 1, wherein said cold cathode comprises an electron emission element having a metal-insulator-metal structure.

8. A cold cathode electronic tube according to claim 1, wherein said electron transit path is at a low pressure.

9. A cold cathode vacuum tube diode according to claim 4, wherein said electron emission cathode comprises an electron emission element having a metal-insulator-metal structure.

10. A cold cathode vacuum tube diode according to claim 4, wherein said electron transit path is at a low pressure.

* * * * *